US006221208B1

(12) United States Patent
Damberg

(10) Patent No.: US 6,221,208 B1
(45) Date of Patent: Apr. 24, 2001

(54) METHOD FOR HEATING AND PRESSURING A FIBRE PULP SUSPENSION DURING TRANSPORTATION TO A BLEACHING REACTOR

(75) Inventor: Håkan Damberg, Hammarö (SE)

(73) Assignee: Kvaerner Pulping AB, Karlstad (SE)

( * ) Notice: Subject to any disclaimer, the term of this patent is extended or adjusted under 35 U.S.C. 154(b) by 0 days.

(21) Appl. No.: 08/913,955

(22) PCT Filed: Mar. 4, 1996

(86) PCT No.: PCT/SE96/00280

§ 371 Date: Jan. 23, 1998

§ 102(e) Date: Jan. 23, 1998

(87) PCT Pub. No.: WO96/30586

PCT Pub. Date: Oct. 3, 1996

(30) Foreign Application Priority Data

Mar. 28, 1995 (SE) ..... 9501094

(51) Int. Cl.[7] ..... D21C 9/10; D21C 9/16

(52) U.S. Cl. ..... 162/52; 162/57; 162/68; 162/78

(58) Field of Search ..... 162/68, 57, 65, 162/78, 52, 246

(56) References Cited

U.S. PATENT DOCUMENTS 5,217,575 6/1993 Backlund ..... 162/65
5,690,786 * 11/1997 Cirucci et al. ..... 162/65

FOREIGN PATENT DOCUMENTS 24 41 579 3/1975 (DE) .

* cited by examiner

*Primary Examiner*—Steve Alvo
(74) *Attorney, Agent, or Firm*—Dorsey & Whitney LLP

(57) ABSTRACT

A method for treating a fiber pulp suspension, which comprises transporting the fiber pulp suspension from a maintenance vessel, in which there is atmospheric pressure or at most 1 bar overpressure and in which the pulp suspension is at a temperature which does not exceed 95° C., to a bleaching reactor and introducing the suspension into the bottom part of the reactor, which is at least 10 m high and at the top of which there is an overpressure which exceeds the steam saturation pressure, in which reactor the pulp is subjected to a bleaching treatment under pressure at a reaction temperature exceeding 100° C., in addition to which the pulp suspension, during the transportation from the maintenance vessel to the reactor, is heated to at least reaction temperature. The pulp suspension is pumped to a mixer with the aid of a first pump which provides 1.5–3 bar overpressure. Low-pressure steam, which is at a pressure of 3–8 bar above atmospheric pressure and a temperature of 135–155° C., is mixed into the pulp suspension in the mixer so that the temperature of the suspension is increased to the desired reaction temperature. After that, the pressure is increased still further with the aid of a second pump 18 after the mixer, so that the heated and pressurized pulp suspension can be pumped into the bottom part of the reactor. The invention also relates to equipment for implementing the method.

16 Claims, 1 Drawing Sheet

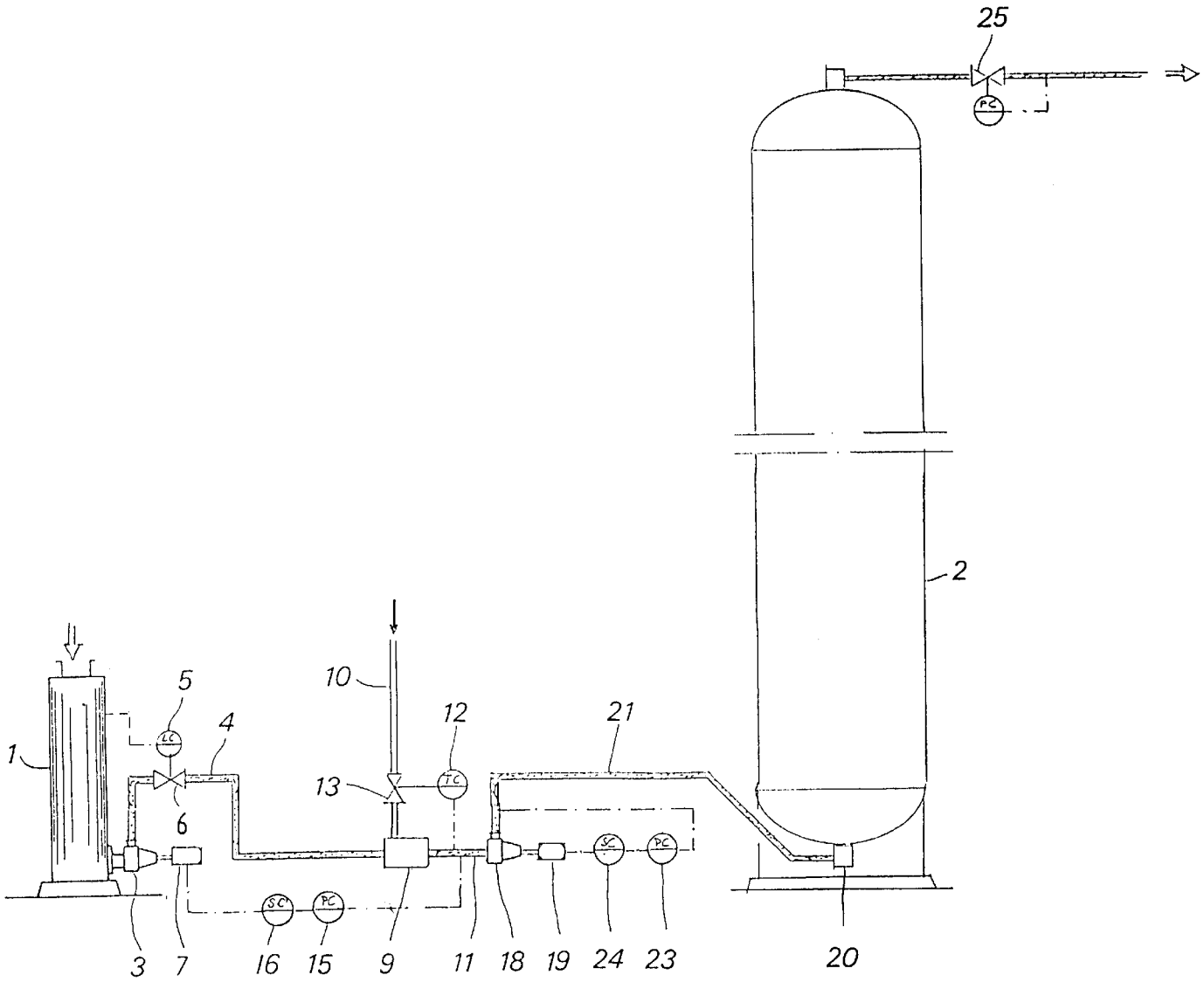
1
2
3
4
5
6
7
9
10
11
12
13
15
16
18
19
20
21
23
24
25

METHOD FOR HEATING AND PRESSURING A FIBRE PULP SUSPENSION DURING TRANSPORTATION TO A BLEACHING REACTOR

RELATED APPLICATIONS

This application claims the priority of PCT Application No. PCT/SE96/00280, filed Mar. 4, 1996, and Swedish Application No. 9501094-8, filed Mar. 28, 1995.

TECHNICAL FIELD

The invention relates to a method for treating a fibre pulp suspension, which comprises transporting the fibre pulp suspension from a maintenance vessel, in which there is atmospheric pressure or at most 1 bar overpressure and in which the temperature of the pulp suspension does not exceed 95° C., to a bleaching reactor and introducing the suspension into the bottom part of the reactor, which is at least 10 m high and at the top of which there is an overpressure exceeding the steam saturation pressure, in which reactor the pulp is subjected to a bleaching treatment under pressure at a reaction temperature which exceeds 100° C., in addition to which the pulp suspension, during transport from the maintenance vessel to the reactor, is heated to at least reaction temperature.

The invention also relates to equipment for treating a fibre pulp suspension, comprising means for transporting the pulp suspension from a maintenance vessel to a bleaching reactor and for introducing the pulp suspension into the bottom part of the reactor, and also means for increasing the temperature of the pulp suspension, during transportation, from a temperature which does not exceed 95° C. to a temperature of at least 100° C.

BACKGROUND TO THE INVENTION

In the bleaching departments of chemical pulp mills, the fibres are normally transported, in the form of a fibre pulp suspension, from a maintenance vessel, for example a so-called standpipe, using a pump which is directly connected to the maintenance vessel. This pump generates a pressure which is sufficiently high to enable the suspension to be transported to the reactor vessel and introduced through the bottom of the latter. On the way, aqueous steam is supplied in a mixer in order to heat the suspension from the said temperature which does not exceed 95° C., for example room temperature or normally approximately 70° C., to a temperature which is suited to the reaction and which is at least 100° C., normally greater. In order to achieve this, the pump pressure has to overcome the losses in pressure along the transportation distance, including a possible loss in pressure through the mixer, and, in particular, overcome the counterpressure in the bottom part of the reactor. This pressure can be considerable, since the reactors in question are tall, giving rise to a high static pressure at the bottom, and, in addition, a process pressure is applied to them. This means, in turn, that it is necessary, to achieve the heating, to use steam which is under a relatively high pressure, usually so-called medium-pressure steam which is available in the pulp mill and which is normally at a pressure of 9–12 bar. A disadvantage of this technique is that medium-pressure steam is expensive. Another limitation is the fact that it becomes difficult, or is rendered impossible, to use a mixer of the type which results in a pressure fall. This is a drawback, since these types of mixer possess certain advantageous properties, such as being relatively simple and cheap.

BRIEF ACCOUNT OF THE INVENTION

An object of the invention is to provide a method and equipment which enable low-pressure steam to be used for heating a fibre pulp suspension in the above-described environment. Low-pressure steam is a cheaper product than the more select medium-pressure steam. The overall economy of the integrated mill is improved if the consumption of medium-pressure steam can be reduced.

Another advantage of the invention is that any mixer type whatsoever, in which aqueous steam can be mixed into a fibre pulp suspension, can be used as the mixer, i.e. both differential pressure mixers of the type which do not contain any continuously moving parts, for example a mixer of the type which is described in WO 9521016 (PCT/SE95/00104), and more conventional mixer equipment containing rotatory members, for example a mixer of the type which is described in SE-B-419 603.

These, and other objects and advantages of the invention, can be achieved by means of the invention being characterized by that which is specified in the subsequent patent claims. Additional features and aspects, and also advantages, of the invention will be evident from the following description of a preferred embodiment.

BRIEF DESCRIPTION OF THE DRAWINGS

The FIGURE schematically shows an embodiment of the invention.

DESCRIPTION OF A PREFERRED EMBODIMENT

The invention will now be described with reference to the FIGURE, which diagrammatically illustrates the preferred embodiment.

In the FIGURE, the numeral 1 represents a maintenance vessel, a so-called standpipe, for a fibre pulp suspension and the numeral 2 represents a bleaching reactor, for example a reactor for delignifying the fibre pulp with hydrogen peroxide at a pressure which exceeds the steam saturation pressure at the top of the reactor, and a pressure which exceeds at least 4 bar at the bottom of the reactor, and a temperature which exceeds 100° C. and is preferably 105–120° C., expediently 105–110° C. The height of the reactor 2 can be substantial, up to 40 m, with greater heights also being conceivable, as a result of which the static pressure at the bottom of the reactor 2, which pressure is added to the reaction pressure, can be considerably greater than the said 4 bar.

The temperature of the fibre pulp suspension in the maintenance vessel 1 is approximately 70° C. and its concentration is 8–18% by weight, preferably 9–12% by weight and, normally, 10–11% by weight of fibres in water. This fibre pulp suspension is to be transported from the maintenance vessel 1 to the reactor 2, to be heated, during the transportation, to a temperature which is suitable and desirable for the delignification in the reactor, and to be pressed in, under high pressure, through the bottom of the reactor. In addition, an aim of the invention is to be able to use low-pressure steam as heating means, as has been mentioned in the brief account of the invention.

According to the invention, this is achieved by a method and equipment which will be described in that which follows. The pulp suspension is pumped out of the maintenance vessel 1 using a first pump 3, which drives the pulp out into a first line section 4 under an over-pressure of 1.5–3 bar. The level in the maintenance vessel 1 is detected using a level sensor which, via a setting device 5, controls a regulating valve 6 in the line section 4. The pump 3 is driven by a first motor 7.

A mixer is designated 9. In principle, this mixer can be of any type whatsoever which enables aqueous steam to be mixed into a fibre pulp suspension. When the pulp suspension reaches the mixer 9, it is at a pressure of at most 3 bar above atmospheric pressure. Steam which is at an overpressure of at least 3 bar and a temperature of 130–190° C. is mixed into this pulp. Normally, according to the invention, low-pressure steam is used which is at a pressure of 3–8 bar above atmospheric pressure, preferably 3–5 bar, and a temperature of 135–155° C., preferably a temperature of 135–145° C.

The temperature of the heated suspension in an outlet line or connecting line 11 from the mixer 9 is detected and, via an automatic mechanism 12, controls a regulating valve 13 in the steam line 10. The pressure, which is normally at most 3 bar, is also detected in the outlet line 11 and, via a pressure converter 15 and an automatic speed-controlling mechanism 16, controls the speed of the first pump 7 and consequently the pressure in the first line section 4. It will be understood that other controlling members can also conceivably be used instead for controlling the speed of the motor, for example a regulating valve in line 4.

After the mixer 9, there follows a second pump 18 which is driven by a second motor 19. This second pump 18 is of the high-pressure type, which increases the pressure of the pulp suspension, which has now been heated by the steam, to a pressure which is greater than the pressure in reactor 2 at the point 20 at which the pulp is fed in at the bottom of the reactor plus the fall in pressure in a second—for example 5–25 meters long—line section 21 between the high-pressure pump 18 and the feed-in point 20, normally at least 10 bar and preferably at most 15 bar overpressure. In this way, the pulp suspension, which has preferably been heated with low-pressure steam, is fed into the reactor 2 at high pressure. The pressure is detected in the second line section 21 in the same way as in the connecting line 11 and controls, via the pressure converter 23 and the speed regulator 24, the speed of revolution of the motor 19 and consequently the pressure in line 21, to achieve the desired pressure of between 10 and 15 bar overpressure. In this case too, it is also possible to conceive of other pressure-regulating systems. It is also possible, as an alternative or in a complementary manner, to control the pressure in the line for discharging the delignified pulp from the top of the reactor 2, as has been indicated in the FIGURE, by means of the pressure-controlled regulating valve 25.

What is claimed is:

1. Method for treating a fibre pulp suspension, which comprises transporting the fibre pulp suspension from a maintenance vessel, in which said fibre pulp suspension maintained under an atmospheric pressure of at most 1 bar overpressure and at a temperature not exceeding 95° C., to a bleaching reactor having a height of at least 10 m, at the top of which there is an overpressure exceeding the steam saturation pressure, and introducing the suspension into the bottom part of the reactor, in which reactor the pulp is subjected to a bleaching treatment in addition to which the pulp suspension, during transport from the maintenance vessel to the reactor, is heated to a temperature which is desirable and suitable for the reaction, characterized in that the pulp suspension is pumped from the maintenance vessel into a first line section to a mixer with the aid of a first pump which generates an increased pressure in the first line section of 1.5–3 bar overpressure, in that steam having a temperature of 130–190° C. and an overpressure of at least 3 bar, which is substantially lower than the pressure in the bottom part of the reactor, is mixed continuously into the pulp suspension in the mixer in a quantity which is so great that the temperature of the suspension is raised to the said temperature which is suitable and desirable for the reaction in the reactor, said temperature which is suitable and desirable being at least 100° C., in that the pressure on the pulp suspension, which has been heated in this manner, is increased still further, with the aid of a second pump after the mixer, to a pressure which is greater than the pressure in the reactor at the feed-in point, and in that the pulp suspension, which has been heated and pressurized in this manner, is pumped into the bottom part of the reactor.

2. Method according to claim 1, characterized in that the said second pump increases the pressure on the pulp suspension to a pressure which is greater than the pressure in the reactor at the feed-in point plus the fall in pressure in a second line section between the said second pump and the feed-in point.

3. Method according to claim 2, characterized in that the second pump increases the pressure to at least 10 and at most 15 bar overpressure.

4. Method according to claim 2, characterized in that the concentration of the pulp suspension is 8–18% by weight.

5. Method according to claim 3, characterized in that the concentration of the pulp suspension is 8–18% by weight.

6. Method according to claim 1, characterized in that the steam which is continuously mixed into the pulp suspension in the mixer consists of low-pressure steam which is at a pressure of 3–8 bar above atmospheric pressure and a temperature of 135–155°.

7. Method according to claim 6, characterized in that the concentration of the pulp suspension is 8–18% by weight.

8. Method according to claim 6, characterized in that the steam is at a pressure of 3–5 bar and a temperature of 135–145°.

9. Method according to claim 8, characterized in that the concentration of the pulp suspension is 8–18% by weight.

10. Method according to claim 1, characterized in that a mixer is used as mixer which lacks rotating mixing members and which is of a type which gives rise to a fall in pressure on the pulp suspension between the inlet and outlet openings of the mixer.

11. Method according to claim 10, characterized in that the concentration of the pulp suspension is 8–18% by weight.

12. Method according to claim 10, characterized in that the fall in pressure through the mixer is at least 1 and at most 2 bar.

13. Method according to claim 12, characterized in that the concentration of the pulp suspension is 8–18% by weight.

14. Method according to claim 1, characterized in that the concentration of the pulp suspension is 8–18% by weight.

15. The method of claim 1, wherein:

said reactor is at least 20 m high, and wherein said pulp subjected to the bleaching treatment is at a reaction temperature which is 105–120° C.

16. The method of claim 1, wherein:

said pulp subjected to the bleaching treatment is at a reaction temperature having a range of 105–11 °C.

* * * * *